US008844163B2

(12) United States Patent
Palazzin et al.

(10) Patent No.: US 8,844,163 B2
(45) Date of Patent: Sep. 30, 2014

(54) LAUNDRY TREATING MACHINE WITH BASEMENT PORTION PROVIDING AIRFLOW PATHS

(75) Inventors: Deborah Palazzin, Pordenone (IT); Alessandro Vian, Meduna di Livenza (IT); Fabio Pasut, Pordenone (IT); Riccardo Quaroni, Arzene (IT); Luciana Riccardi, legal representative, Arzene (IT)

(73) Assignee: Electrolux Home Products Corporation N.V., Brussel (BE)

( * ) Notice: Subject to any disclaimer, the term of this patent is extended or adjusted under 35 U.S.C. 154(b) by 348 days.

(21) Appl. No.: 13/211,566

(22) Filed: Aug. 17, 2011

(65) Prior Publication Data

US 2012/0049704 A1 Mar. 1, 2012

(30) Foreign Application Priority Data

Aug. 25, 2010 (EP) ..... 10173931

(51) Int. Cl.
*D06F 58/10* (2006.01)
*D06F 58/20* (2006.01)
*D06F 39/12* (2006.01)

(52) U.S. Cl.
CPC ..... *D06F 58/20* (2013.01); *D06F 39/12* (2013.01)
USPC ..... 34/603; 34/139; 34/233

(58) Field of Classification Search
CPC ..... D06F 58/10; D06F 58/20; D06F 58/206; D06F 58/24
USPC ..... 34/603, 604, 605, 139, 225, 233; 312/236
See application file for complete search history.

(56) References Cited

U.S. PATENT DOCUMENTS

| | | | | |
|---|---|---|---|---|
| 2,503,329 | A | 4/1950 | Geldhof et al. | |
| 2,694,867 | A | 11/1954 | Smith | |
| 2,742,708 | A * | 4/1956 | McCormick | 34/76 |
| 2,830,384 | A | 4/1958 | Zehrbach | |
| 5,066,050 | A * | 11/1991 | Kretchman | 285/319 |
| 5,546,678 | A | 8/1996 | Dhaemers | |
| 6,088,932 | A | 7/2000 | Adamski et al. | |
| 6,877,248 | B1 | 4/2005 | Cross et al. | |
| 7,121,018 | B2 | 10/2006 | Lee | |
| 7,913,419 | B2 | 3/2011 | Tomasi et al. | |

(Continued)

FOREIGN PATENT DOCUMENTS

| | | |
|---|---|---|
| DE | 10 2005 013051 | 9/2006 |
| DE | 10 2006 023952 | 11/2006 |

(Continued)

OTHER PUBLICATIONS

Extended European Search Report issued on Mar. 22, 2011 in related European Application No. 10173929.0.

(Continued)

*Primary Examiner* — Jiping Lu
(74) *Attorney, Agent, or Firm* — Banner & Witcoff, Ltd

(57) ABSTRACT

A laundry treating machine includes a basement portion (14) having an upper side (17) with seats (18A-18F) formed thereon for receiving machine operational devices (5), and a lower side (16), opposite to the upper side (17). The lower side (16) forms an air path for air to be admitted into or exhausted from the machine.

13 Claims, 7 Drawing Sheets

(56) References Cited

U.S. PATENT DOCUMENTS

| | | | | |
|---|---|---|---|---|
| 7,984,568 | B2 | 7/2011 | Dittmer et al. | |
| 8,307,567 | B2 * | 11/2012 | Han et al. | 34/73 |
| 2003/0126691 | A1 | 7/2003 | Gerlach et al. | |
| 2005/0050765 | A1 * | 3/2005 | Park et al. | 34/603 |
| 2005/0066538 | A1 | 3/2005 | Goldberg et al. | |
| 2007/0017115 | A1 | 1/2007 | Woolston et al. | |
| 2007/0113421 | A1 | 5/2007 | Uhara et al. | |
| 2008/0034607 | A1 | 2/2008 | Ahn et al. | |
| 2008/0141555 | A1 | 6/2008 | Hoogendoorn et al. | |
| 2008/0289209 | A1 | 11/2008 | Han et al. | |
| 2009/0064530 | A1 | 3/2009 | Moon et al. | |
| 2009/0113740 | A1 | 5/2009 | Grunert et al. | |
| 2010/0011608 | A1 | 1/2010 | Grunert et al. | |
| 2010/0132216 | A1 | 6/2010 | Krausch et al. | |
| 2010/0192639 | A1 | 8/2010 | Kim et al. | |

FOREIGN PATENT DOCUMENTS

| | | | |
|---|---|---|---|
| DE | 10 2006 005809 | | 8/2007 |
| EP | 0 344 434 | | 6/1989 |
| EP | 1103648 | | 5/2001 |
| EP | 1 508 636 | | 2/2005 |
| EP | 1 548 178 | | 6/2005 |
| EP | 1 925 712 | | 5/2008 |
| EP | 2 163 681 | | 3/2010 |
| EP | 2 166 145 | | 3/2010 |
| GB | 2 145 206 | | 3/1985 |
| GB | 2145206 | A * | 3/1985 |
| JP | 01242098 | A * | 9/1989 |
| JP | 2001-070697 | | 3/2001 |

OTHER PUBLICATIONS

Extended European Search Report issued on Feb. 16, 2011 in related European Application No. 1017393.9.

Non-Final Office Action mailed Jun. 27, 2013 in related U.S. Appl. No. 13/211,628.

Non-Final Office Action mailed Jun. 25, 2013 in related U.S. Appl. No. 13/211,592.

Non-Final Office Action mailed Jun. 19, 2012 in related U.S. Appl. No. 13/211,592.

Final Office Action mailed Dec. 18, 2012 in related U.S. Appl. No. 13/211,592.

Final Office Action mailed Dec. 16, 2013 in related U.S. Appl. No. 13/211,592.

* cited by examiner

LAUNDRY TREATING MACHINE WITH BASEMENT PORTION PROVIDING AIRFLOW PATHS

CROSS-REFERENCE TO RELATED APPLICATION

This application claims priority to European Application No. 10173931.6, filed on Aug. 25, 2010.

BACKGROUND OF THE INVENTION

Laundry treating machines capable of carrying out a drying process on laundry generally comprise a casing that houses a laundry container, like a rotating drum, where laundry to be treated is received, a basement portion having seats for receiving machine operational devices, and an air circuit for carrying out drying operation by circulating hot air through the laundry container. Air circulating means and heating means are provided in the air circuit for circulating and heating drying air, respectively. In condenser type dryers, condensing means are further provided in the air circuit for removing moisture from drying air passing through articles to be treated thereby allowing said air to be recirculated cyclically within the air circuit. Moisture removed from articles is either collected in a tank periodically emptied by a user or it is directly exhausted by a pipe connected to a waste water net.

Washing-drying appliances, i.e. appliances provided for performing articles washing and drying operations in a single machine are also known and generally comprise a water circuit including pumping means for allowing washing water to be supplied to a laundry treating chamber and a drying arrangement as described before for drying laundry.

In the following description the invention will be disclosed with particular reference to a machine suitable for carrying out a drying operation on laundry such as a laundry drying machine or a washing-drying machine. However, in general, principles of the invention may be applied to a laundry treating appliance, for example in cases when an air flow is needed to cool machine operating devices or part thereof.

In a known condenser type laundry dryer, means for condensing moisture removed by articles are configured in many different ways. Typical examples comprise an air-air heat exchanger or an evaporator of a heat pump circuit incorporated within the dryer. Such condensing means or components thereof require cooling in order to constantly provide a cold surface where wet drying air can be condensed or to remove heat produced by said components, like a compressor in a heat pump circuit. Normally, air taken from dryer machine surroundings is used as cooling means of a condenser or components thereof. For this reason a plurality of conduits are provided on the lower portion of the laundry treating machine and, generally, a basement portion is appropriately designed to form at least a portion of cooling conduits.

In prior art laundry drying machines such cooling conduits are generally formed on the upper side of machine basement, i.e. on the basement side facing the laundry container. However such construction is particularly disadvantageous because it complicates the arrangement of further machine operating devices like air pumping means, motor means and so on. A further drawback of such prior art laundry drying machines exists in that the position of air conduits on the basement upper side causes the air ports on machine casing walls to be either placed at a high position relative to the machine resting surface or to be placed on lower region of casing lateral wall by complicatedly connecting them with air conduits. This arrangement leads to an efficiency reduction and therefore an increase in power losses.

Another drawback of prior art laundry drying machines as described above is high noise produced by cooling air circulating through conduits having complex and tortuous paths.

SUMMARY OF SELECTED INVENTIVE ASPECTS

An aim of the present invention is therefore to solve the noted drawbacks and thus provide a laundry treating machine having an improved basement arrangement.

An object of the present invention is to provide a laundry treating machine with a basement having a more compact and rational design that improves the arrangement of machine operational devices thereon.

Another object of the present invention is to provide a laundry treating machine suitable for carrying out a drying process on laundry having an improved performance in cooling condensing means and/or components thereof, said laundry treating machine ensuring an efficient cooling air flow.

A further object of the invention is to provide a laundry treating machine producing a low noise during working operation compared to laundry treating machines of known type.

Another object of the invention is to provide a laundry treating machine which is easy to be assembled.

Advantages, objects, and features of the invention will be set forth in part in the description and drawings which follow and in part will become apparent to those having ordinary skill in the art upon examination of the following or may be learned from practice of the invention.

According to an aspect of the present invention, there is provided a laundry treating machine comprising a basement portion having an upper side with seats formed thereon for receiving machine operational devices, and a lower side, opposite the upper side, characterized in that the lower side forms an air path for air to be admitted into or exhausted from the machine.

Preferably, a bottom wall is associated to the lower side of basement such that at least one hollow space is formed therein to define the air path.

Preferably, an air passage is formed on the bottom wall.

Preferably, the at least one hollow space comprises a partition forming separated air conduits.

Preferably, the air flows along the separated air conduits are in opposite directions.

Preferably, the separated air conduits comprise, respectively, a fluid inlet opening and a fluid outlet opening.

Preferably, a fluid inlet opening is provided on a front wall of a casing.

Preferably, an outlet fluid opening is provided on the front wall of a casing.

Preferably, the upper side of the basement directs the air path towards the operational devices, the air path lying on different height levels of the basement.

Preferably, a conveyor is provided for reversing the air path from one of the levels to the other.

Preferably, the conveyor comprises an inner transverse section surface area which gradually increases from one of the layers to the other so as to create a Venturi effect.

Preferably, the conveyor is arranged perpendicularly relative to the bottom wall and it is removably attached to the wall by means of a spring clip.

Preferably, the air path comprises a cooling air open-circuit for cooling at least a part of the operational devices comprise at least one of the following: motor means, fluid compressing means, heat exchanging means, fluid condensing and/or evaporating means, and a portion of a heat pump circuit.

Preferably, covers are provided for closing the seats formed on the basement portion.

Preferably, the upper side of the basement forms a further air path for the air to pass through/over the operational device(s), the air path and the further air path extending at opposite sides of the basement.

Preferably, the laundry treating machine is a laundry dryer or a washing-drying appliance.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention. Like reference numbers represent like features throughout the accompanying drawings, wherein.

DETAILED DESCRIPTION OF EXAMPLE EMBODIMENTS

Figure 1:
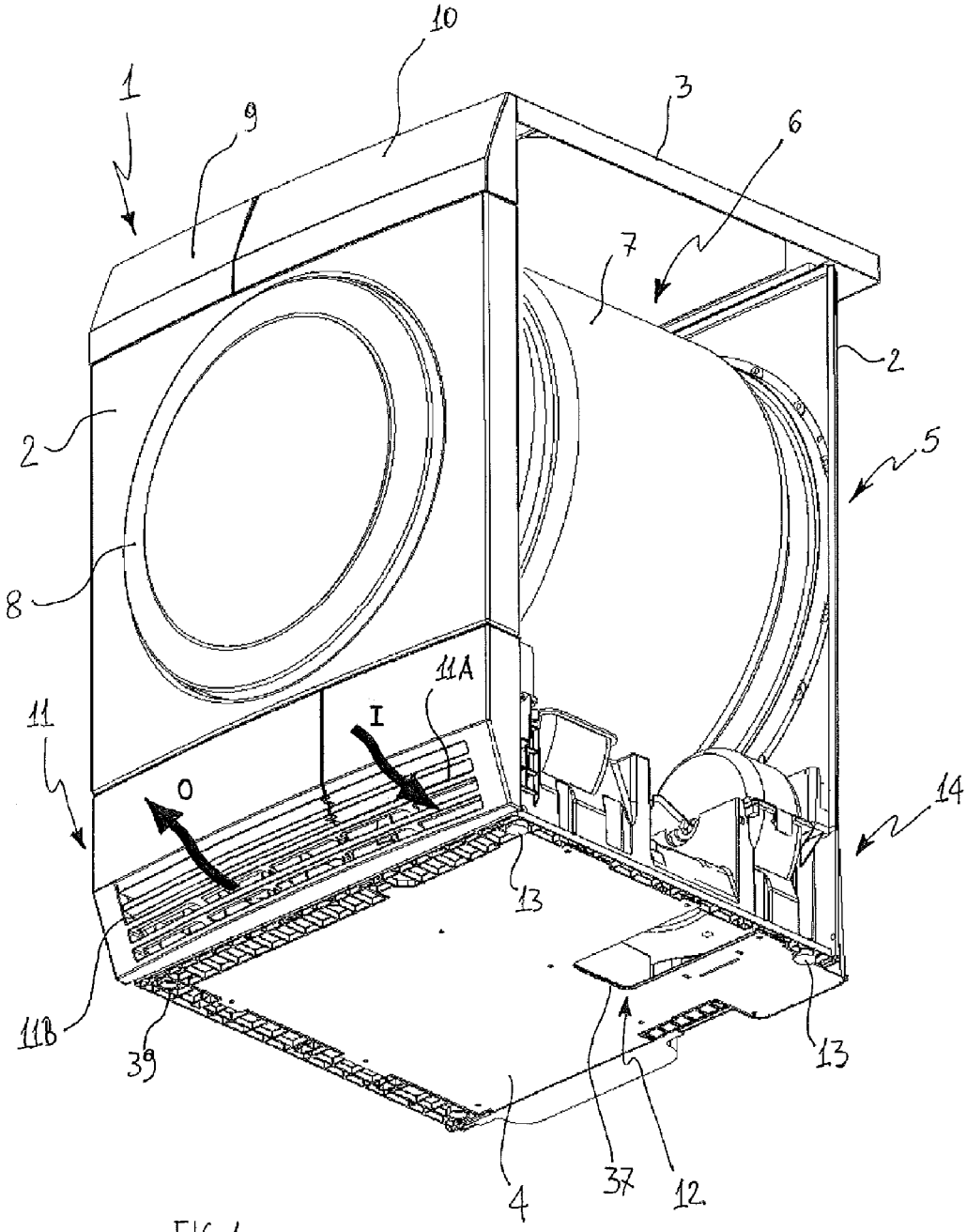
FIG. 1 shows a perspective bottom view of a laundry treating machine according to the invention with an upright side wall removed.

With reference to FIG. 1, a laundry treating machine according to the invention comprises a casing 1 formed by two couples of upright side walls 2 arranged perpendicularly of one another, one wall being on the treating machine rear part and another on the front part, and the two remaining walls being on the lateral sides thereof. In FIG. 1, one of the lateral side walls has been removed for showing some of the laundry treating machine operational devices 5 accommodated within casing 1. An upper wall portion 3 and a bottom wall portion 4 close the ends of the box-like structure formed by the upright side walls 2 joined together.

A laundry container 6 comprising a drum (not shown) rotatably mounted in a tub 7 is provided within the casing 1. A front door 8, pivotally coupled to the front upright side wall 2, is provided for allowing access to the drum interior region to place laundry to be treated therein. An extractable moisture tank in the form of a drawer 9 is slidably arranged on the top of the casing 1, for being periodically emptied by a user in case the laundry treating machine cannot be connected to a waste water net through a pipe. A user control interface 10 is arranged on the top of the casing 1 near the drawer 9 for input of laundry treatment programs and displaying machine working conditions.

On a bottom portion of the casing 1 and preferably in its front upright side wall 2 an air passage 11 is provided for draining air from/to the laundry treating machine. In the exemplary embodiment of the invention disclosed in the Figures, air passage 11 is divided into two portions 11A, 11B for allowing cooling air to enter and exit the casing 1, as indicated by arrows "I" and "O" in FIG. 1, in order to cool condensing means arranged in a drying air circuit passing through the laundry container 6 for removing moisture from said drying air. If desired, portions 11A and 11B of air passage 11 may be arranged on different upright side walls 2 other than the laundry treating machine front wall.

According to an embodiment of the invention, an air passage 12 is formed as an opening 37 in the bottom wall portion 4. Such air passage 12 is always accessible to air because the bottom wall 4 extends in a position that is spaced apart and substantially parallel to a floor on which the laundry treating machine is placed. The distance between bottom wall 4 and a floor is determined in an adjustable manner through vertically adjustable supports 13 (only two of them are shown in FIG. 1) placed under the casing 1. The bottom wall portion 4 comprises a sheet that is removably mounted onto a lower side 16 of (i.e. under) a basement 14 which is preferably made of polymeric material. The lower side 16 and the bottom wall portion 4 delimit a hollow space 38 adapted to convey air inside the machine and/or to discharge air outside the machine.

In particular, bottom wall 4 rests on the same level of a lower edge 39 of basement 14 that surrounds a hollow space 38 upwardly limited by surfaces placed on a higher level relative to edge 39. On an upper side 17 of the basement 14, seats 18A-18F are formed for receiving therein operational devices 5 of the laundry treating machine, like condensing means (condenser) 19, air pumping means (pump) 20, motor means (motor) for powering air pumping means 20 and other functional devices for operating laundry treating machine to carry out a drying treatment on laundry as, for example, heat pump circuit components (not shown in FIG. 1) like fluid compressing means (compressor), heat exchanging means (heat exchanger), fluid condensing and/or evaporating means (condenser and/or evaporator). In practice, basement 14 comprises a lower side 16 forming at least a portion of a first air path wherein the air is drawn in from outside the machine and/or the air is exhausted outside the machine and further comprises an upper side 17 forming at least a portion of a second air path that passes through one or more of said operational devices 5.

Figure 2:
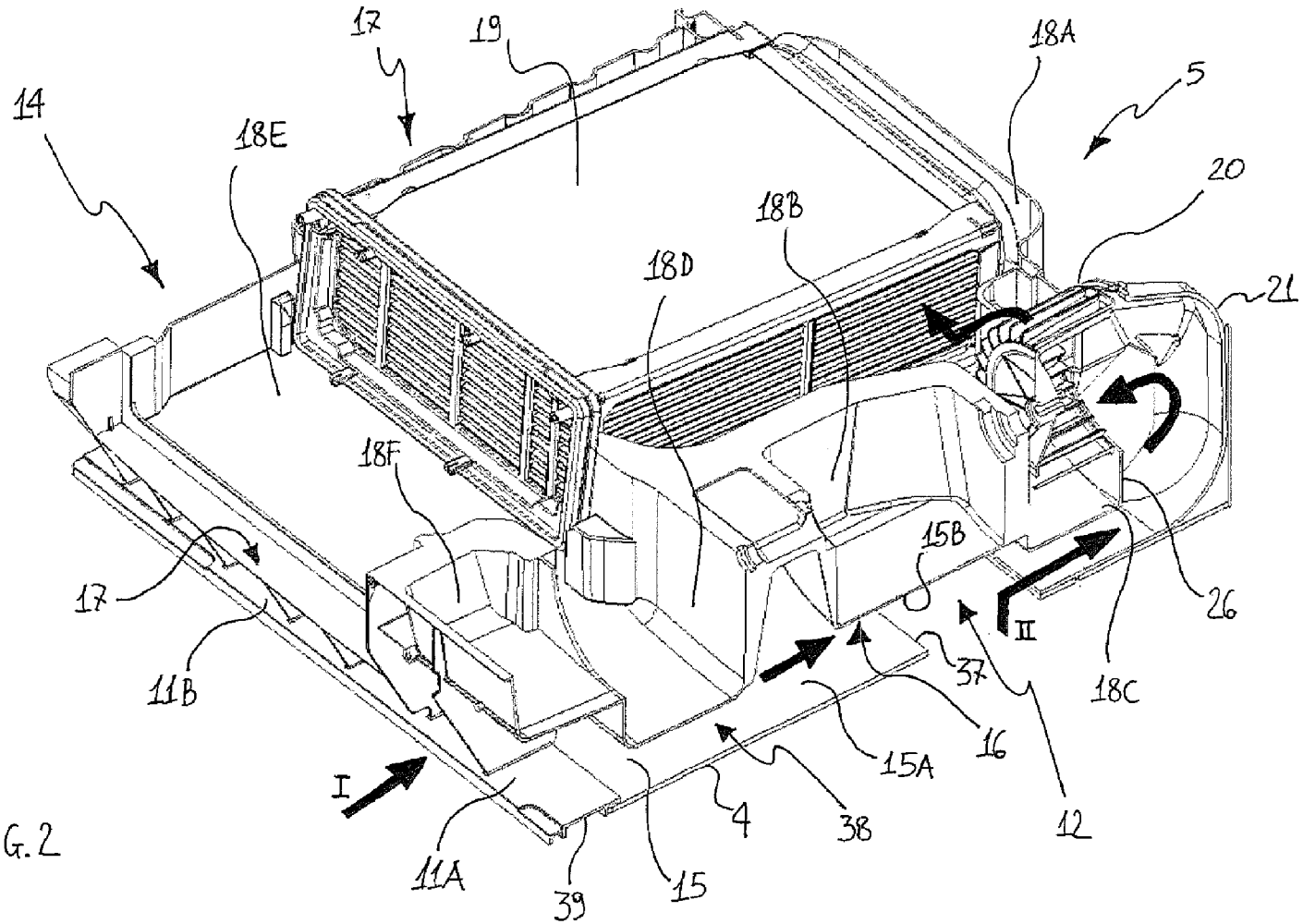
FIG. 2 shows a perspective sectional view of a basement of the laundry treating machine illustrated in FIG. 1.

As shown in FIG. 2, when the bottom wall portion 4 is associated under the basement 14 facing the lower side 16 of the latter, said bottom wall 4 substantially covers the hollow space 38 formed in the lower side 16 of basement 14 thereby forming an inlet conduit 15 for conveying air entering the laundry treating machine through air passages 11A, 12 as shown by arrows "I" and "II". Such conduit 15 has a lower surface 15A defined by the bottom wall 4 and upper surfaces 15B that are defined by the basement 14 itself through the surfaces upwardly limiting the hollow space 38 formed in the basement 14 lower side 16. If desired, air passage 12 in the bottom portion 14 may be the only aperture for allowing fluid communication between the environment where the laundry treating machine is installed and an air path circulating within said machine. In particular, air passage 12 may be in fluid communication with a laundry treatment air flow path, such as the drying air passing through the drum.

Conduit 15 sucks air taken from outside by pumping means 20 for cooling condensing means 19 resting within seat 18A. Pumping means 20 are powered though an electric motor (not shown) housed in the seat 18B which is formed in the upper side 17 of basement 14. Said motor powers also further pumping means (not shown) that are arranged coaxially with pumping means 20 and received within seat 18D to circulate drying air through the laundry container 6. Motor means are interposed between pumping means 20 and those for circulating drying air. Rotational axis of the electric motor shaft extends parallel to the air flow path within conduit 15.

Pumping means 20, that preferably comprises a centrifugal fan, are arranged on a level of the basement 14 that extends just over conduit 15 that rests on a lower level, therefore air path along conduit 15 is reversed and lead to said level by means of a conveyor 21 arranged between the air inlet port of pumping means 20 and conduit 15. Conveyor 21 is preferably made of felt and it is designed to reduce flow resistance when the air reverses its path of about 180 degrees increasing its height relative to the floor where the laundry treating machine rests. In this way performance of the laundry treating machine is not negatively affected, while an improved compactness in distributing operational devices on the basement 14 may be achieved. More specifically, conveyor 21 may be made by conferring the desired shape to a felt sheet of appropriate thickness and density. Such a construction can be beneficial for lowering noise in a point of the air circuit where air changes direction. The use of felt sheeting can facilitate the assembly of the conveyor to the basement body because the shaped felt remains sufficiently pliable/deformable, and thus lower production costs.

Figure 6:
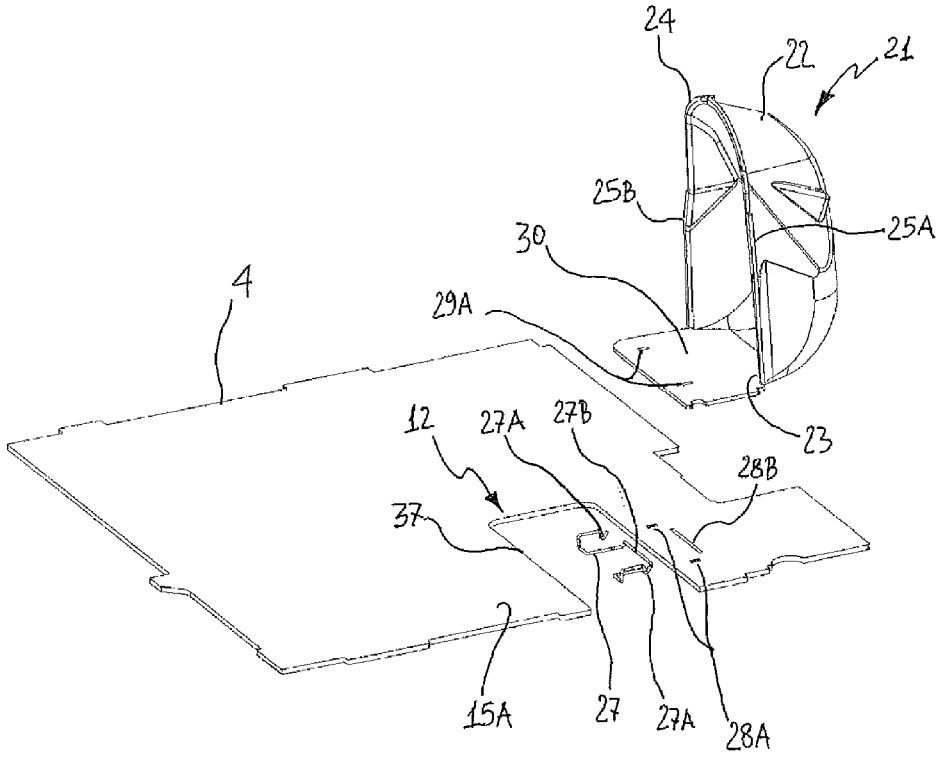
FIG. 6 shows an exploded view of an attachment between an air flow conveyor and a bottom wall of the laundry treating machine basement illustrated in FIG. 2.
Figure 7:
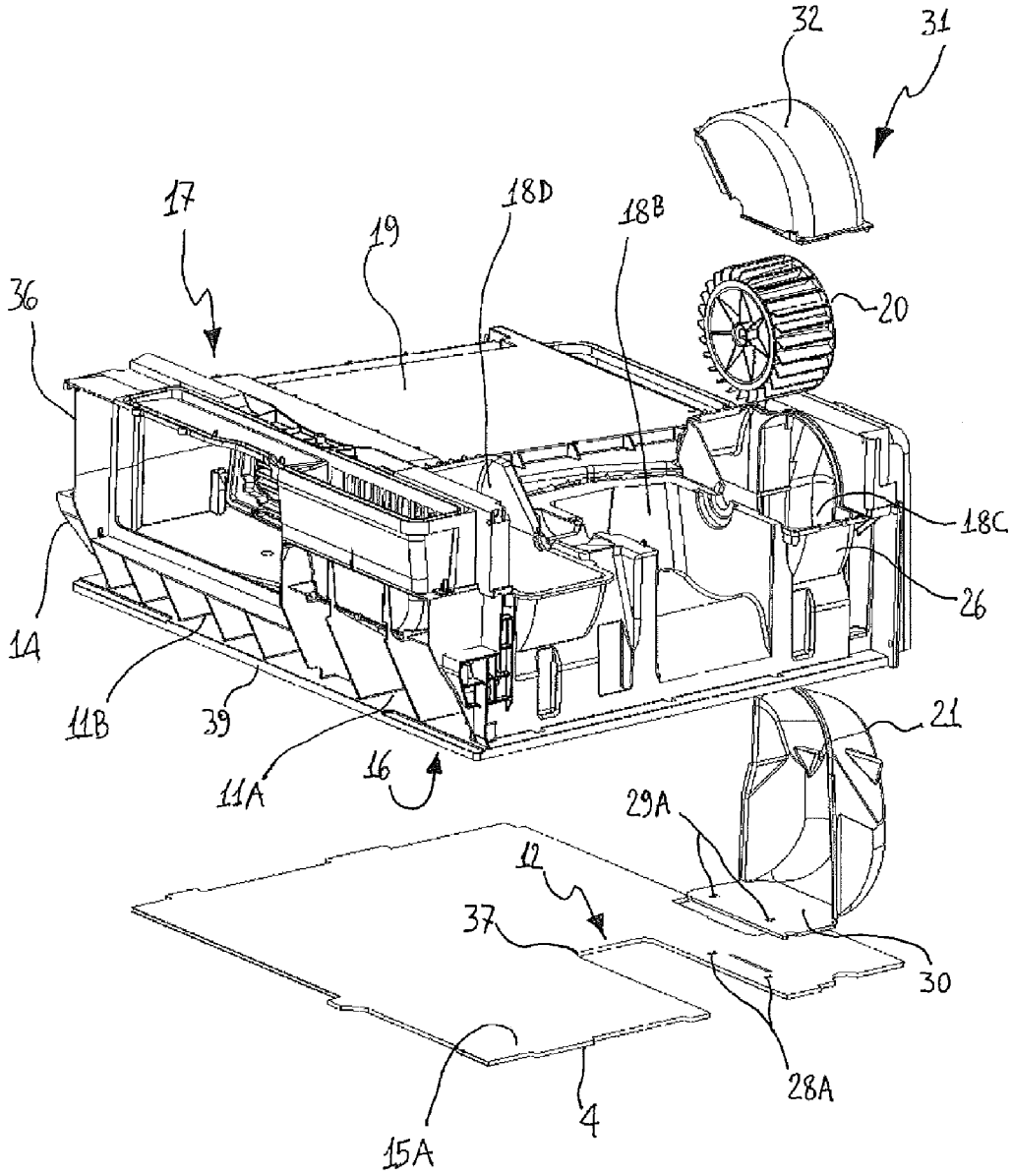
FIG. 7 shows a partially exploded view of the laundry treating machine basement illustrated in FIG. 2.

In FIG. 6 it is shown in detail a configuration of conveyor 21 and its attachment to the bottom wall 4. Conveyor 21 comprises an elongated cup-like body 22 having two opposite ends 23, 24 respectively adapted to be joined to a section of conduit 15 and to an air inlet port of pumping means 20. Said ends 23, 24 are linked each other by walls 25A, 25B, that cooperate with basement 14 to create a Venturi effect in the air flowing outside conduit 15 and entering pumping means 20 through conveyor 21. For this aim, the inner transverse section surface area of said conveyor 21 gradually increases from the conveyor inlet port to be associated with conduit 15 to the conveyor outlet port to be associated with pumping means 20. Therefore while passing through conveyor 21, air increases its pressure and reduces its speed. A portion 26 (see FIGS. 1 and 3) of the basement 14 forms at least a part of a volute 31 and an air inlet port for pumping means 20 and it extends between ends 23, 24 thereby defining two separate ports for admitting and draining air from conveyor 21. As can be seen in FIG. 7, volute 31 is formed by portion 26 of basement 14 and by a cover 32 which is removably attached to portion 26 through snap-fit fasteners 33 (FIG. 3) thereby closing seat 18C. Even though it is not shown in the Figures, a similar arrangement is also provided for pumping means received within seat 18D to circulate drying air through the laundry container 6.

Conveyor 21 is arranged perpendicularly relative to bottom wall 4 and it is removably attached to said wall 4 by means of a spring clip 27 provided with protruding portions 27A, 27B that can be received within slots 28A, 28B formed onto the bottom wall 4 and within slots 29A formed onto a base member 30 in a position corresponding to that of slots 28A. When in locking condition, spring clip 27 extends over the base member 30 with its protruding portions 27A and under the bottom wall 4 with its protruding portion 27B. Base member 30 lies over the bottom wall 4 on the lower surface 15A of conduit 15. In order to tightly seal conveyor 21 onto the conduit 15 outlet section and the air inlet port of pumping means 20, a gasket may be over-injected on the edges of conveyor 21 that join conduit 15 and the edge of portion 26 defining the air inlet port of pumping means 20.

Air sucked by pumping means 20 is output centrifugally from the latter and directed towards condensing means 19 as shown by arrows in FIG. 2. Preferably, condensing means 19 are in the form of an air-air cross-flow type heat exchanger When air passes through condensing means 19 its path lies on an upper level compared to the air flowing within conduit 15. Even the flow direction of air within conduit 15 is substantially perpendicular to that of air flowing through condensing means 19. Seat 18A, that houses condensing means 19, is shaped to diffuse air coming out from pumping means 20 to the whole surface of condensing means 19.

Figure 3:
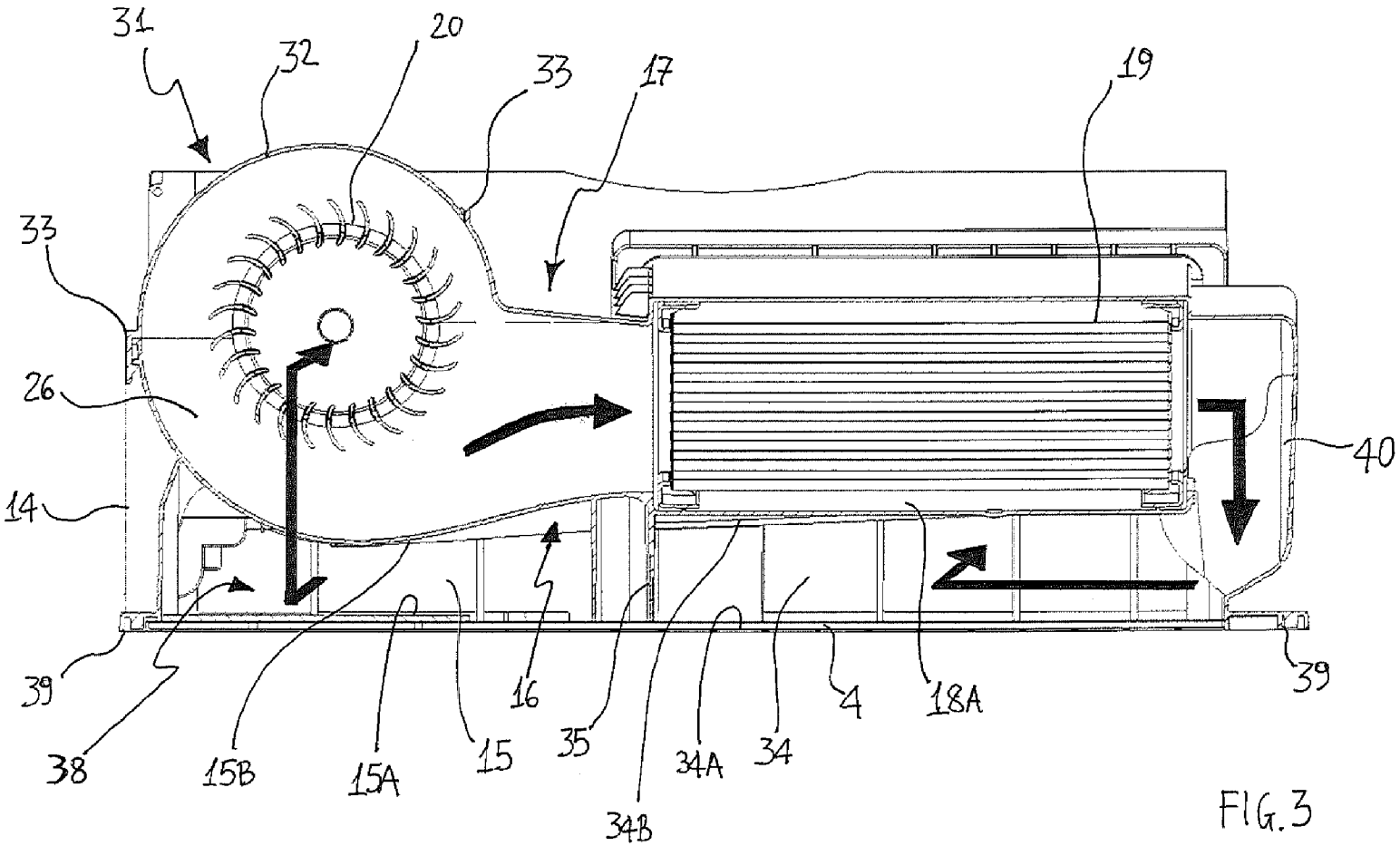
FIG. 3 shows a rear sectional view of air pumping means and condensing means arranged on the laundry treating machine basement illustrated in FIG. 2.
Figure 4:
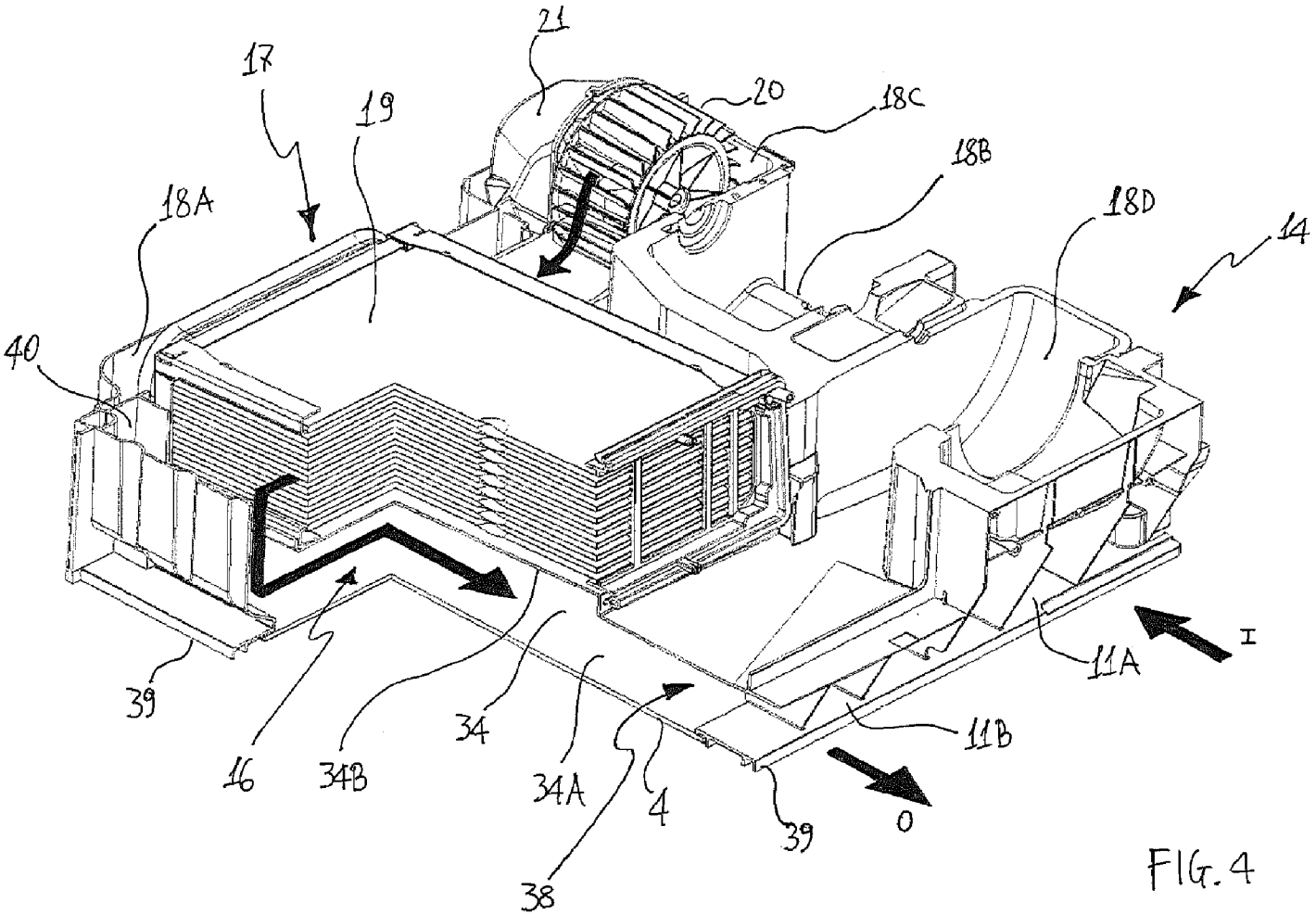
FIG. 4 shows a perspective sectional view of the laundry treating machine basement of FIG. 2 from a reverse angle view.

In FIG. 3 it is shown from a rear sectional view of the basement 14 the air path flowing through condensing means 19 and then downwardly towards bottom wall 4. Air that exits condensing means 19 is guided from said upper side 17 to a lower side 16 of basement 14 by means of a conduit portion, or conveyor, 40 formed in the basement 14, for example by joining a cover to a upper side 17 of basement 14. Conveyor 40 may have the same features of conveyor 21, i.e. they may be substantially identical. Air conveyed by conduit portion 40 is also reversed in its flow direction of about 180 degrees and it is then received in an outlet conduit 34 which is formed in a manner similar to inlet conduit 15, i.e. by a lower surface 34A defined by the bottom wall 4 and an upper surface 34B that is defined by the basement 14 itself through the surface upwardly limiting a further hollow space 38 formed in the basement 14 lower side 16. Another view of the air path leaving condensing means 19 for entering outlet conduit 34 is shown in FIG. 4 where outlet conduit 34 has been partly cut away and in FIG. 5 where the bottom wall 4 has been removed. Outlet conduit 34 and inlet conduit 15 are separated and substantially tightly sealed by a partition 35 (FIGS. 3 and 5) that extends downwardly (i.e. towards bottom wall 4) from joining region between upper surface 15B of inlet conduit 15 and upper surface 34B of outlet conduit 34. Upper surfaces 15B, 34B and partition 35 are made integrally, i.e. as a unitary body, such as a single-piece construction by molding.

Figure 5:
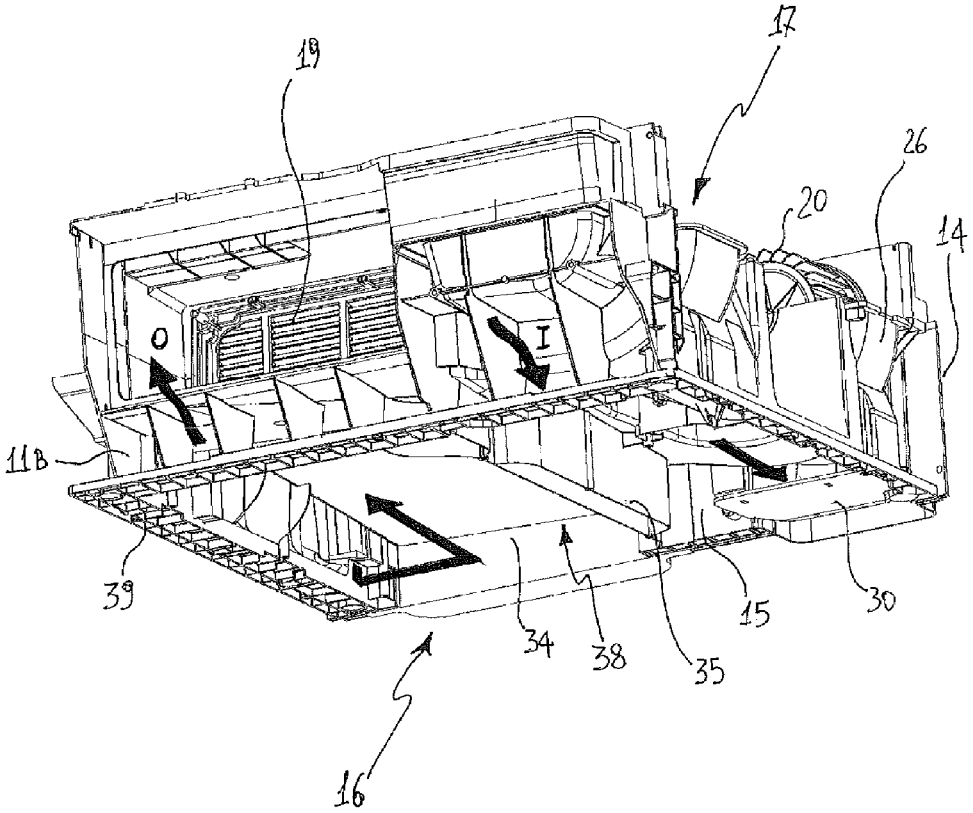
FIG. 5 shows a perspective bottom view of the laundry treating machine basement of FIG. 2 where a bottom wall portion has been removed.

Outlet conduit 34 leads air from condensing means 19 to exit laundry treating machine through an outlet air passage 11B as indicated by arrow "O" in FIGS. 1, 4 and 5. Air coming out from air passage 11B hardly affects temperature of cooling air sucked into the laundry treating machine thanks to the provision of an air passage 12 in the bottom wall 4. In fact, provision of air passage 12 as the sole or auxiliary air inlet port ensures to provide the laundry treating machine with air in the conditions as it is in the environment where said machine is placed.

FIG. 7 further illustrates how the basement 14 can be assembled with conveyor 21 and further covers 32, 36 to house operational devices of laundry treating machine. Cover 36, in particular, is removably joined preferably by snap-fit means in the front upper part of the basement 14 to direct drying air flow from the condensing means 19 to the laundry container 6. Assembling operation of laundry treating machine, and, in general of its operational devices, may be greatly simplified and made more compact.

Preferably, the upper surfaces 15B, 34B of the basement 14 can comprise one or more opening so as to direct a part of the air flowing along the lower side 16 of the basement 14 into at least one of the seats 18A-18F for cooling purpose, for example to cool an electric motor or heat pump circuit components.

A laundry treating machine according to an aspect of the invention has an efficient arrangement for its basement portion which enhances layout of operational devices and air path formed thereon. Thanks to the inventive basement arrangement, noise produced by a laundry treating machine for moving air mass can be greatly lowered, thereby allowing the machine to be placed and operated close to rooms where, and at times (e.g., during night hours) that, low noise or silence is required.

The present invention can be applied to any type of laundry treating machine, such as a condenser-type laundry dryer and open-circuit laundry dryers, or to washing machines.

The invention claimed is:

1. A laundry treating machine comprising a basement portion partitioned into an upper side with seats formed thereon, upon which are seated machine operational devices including an air-receiving heat exchanger, and a lower side, opposite to and below the upper side, wherein said lower side forms two portions of an air flow path for cooling air to be admitted into and exhausted from said machine, respectively, said air flow path extending on said upper side, between said two portions, through said air-receiving heat exchanger, said two portions extending, respectively, to an air inlet opening on said lower side for admitting said cooling air into said machine and an air outlet opening on said lower side for exhausting said cooling air from said machine.

2. A laundry treating machine according to claim 1, wherein a bottom wall is associated to said lower side of said basement such that hollow spaces are formed therein to define said two portions of said air flow path.

3. A laundry treating machine according to claim 2, wherein said air inlet opening is formed in said bottom wall.

4. A laundry treating machine according to claim 2, wherein said hollow spaces are separated from each other by a partition wall.

5. A laundry treating machine according to claim 4, wherein the air flow directions along said two portions of said air flow path are opposite to each other.

6. A laundry treating machine according to claim 1, wherein a said air inlet opening is provided on a front wall of an outer casing of the laundry treating machine.

7. A laundry treating machine according to claim 1, wherein said air outlet opening is provided on a front wall of an outer casing of the laundry treating machine.

8. A laundry treating machine according to claim 1, wherein a conveyor is provided for conveying said cooling air from said lower side to said upper side, reversing a direction of air flow from the lower side to the upper side.

9. A laundry treating machine according to claim 8, wherein said conveyor comprises an inner transverse section surface area which gradually increases from said the lower side to the upper side so as to create a Venturi effect.

10. A laundry treating machine according to claim 8, wherein a bottom wall is associated to said lower side of said basement such that hollow spaces are formed therein to define said two portions of said air flow path, and said conveyor is arranged perpendicularly relative to the bottom wall and is removably attached to said wall by means of a spring clip.

11. A laundry treating machine according to claim 1, wherein said operational devices further comprise at least one of the following: a motor, a fluid compressor, a fluid condenser and/or evaporator, and a portion of a heat pump circuit.

12. A laundry treating machine according to claim 1, wherein covers are provided for closing said seats.

13. A laundry treating machine according to claim 1, wherein said machine is a laundry dryer or a washing-drying appliance.

* * * * *